US008043653B2

(12) United States Patent
Kweon

(10) Patent No.: US 8,043,653 B2
(45) Date of Patent: Oct. 25, 2011

(54) METHOD OF FORMING A DIELECTRIC FILM AND PLASMA DISPLAY PANEL USING THE DIELECTRIC FILM

(75) Inventor: Tae-Joung Kweon, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 0 days.

(21) Appl. No.: 12/292,533

(22) Filed: Nov. 20, 2008

(65) Prior Publication Data

US 2009/0098279 A1 Apr. 16, 2009

Related U.S. Application Data

(62) Division of application No. 10/974,861, filed on Oct. 28, 2004, now Pat. No. 7,482,753.

(30) Foreign Application Priority Data

Oct. 30, 2003 (KR) ..... 2003-76227

(51) Int. Cl.
*B05D 5/12* (2006.01)

(52) U.S. Cl. ..... 427/67; 427/68; 427/282; 427/287; 313/485; 313/586; 313/635

(58) Field of Classification Search ..... 427/64–73, 427/282, 287; 313/485, 586, 635
See application file for complete search history.

(56) References Cited

U.S. PATENT DOCUMENTS 3,672,934 A * 6/1972 Larry ..... 427/210
5,541,618 A 7/1996 Shinoda
(Continued)

FOREIGN PATENT DOCUMENTS

CN 1448960 10/2003
(Continued)

OTHER PUBLICATIONS

"Final Draft International Standard", Project No. 47C/61988-1/Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner* — Frederick Parker
*Assistant Examiner* — Alex Rolland
(74) *Attorney, Agent, or Firm* — Robert E. Bushnell, Esq.

(57) ABSTRACT

In method of forming a dielectric film and a Plasma Display Panel (PDP) using the dielectric film, a paste is coated on a substrate and forms a dielectric film, and a lateral surface of a terminal portion of the dielectric film has a contact angle in a range of 30 to 80° with respect to a surface of the substrate. The PDP preferably includes: a first substrate and a second substrate facing each other and forming a discharge space; a plurality of pairs of sustain electrodes arranged on the first substrate; and a plurality of address electrodes arranged on the second substrate. At least one dielectric film is preferably arranged between the first substrate and the second substrate, and a lateral surface of a terminal portion of the dielectric film preferably has a contact angle in a range of 30 to 80° with respect to a surface of the first substrate.

8 Claims, 3 Drawing Sheets

U.S. PATENT DOCUMENTS

| | | | | |
|---|---|---|---|---|
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,742,122 | A * | 4/1998 | Amemiya et al. | 313/582 |
| 5,786,794 | A | 7/1998 | Kishi et al. | |
| 5,952,782 | A | 9/1999 | Nanto | |
| 6,184,621 | B1 | 2/2001 | Horiuchi et al. | 313/586 |
| RE37,444 | E | 11/2001 | Kanazawa | |
| 6,630,916 | B1 | 10/2003 | Shinoda | |
| 6,646,376 | B2 * | 11/2003 | Yonehara et al. | 313/582 |
| 6,707,436 | B2 | 3/2004 | Setoguchi et al. | |
| 7,002,296 | B2 | 2/2006 | Sano et al. | 313/583 |
| 7,074,101 | B2 | 7/2006 | Adachi et al. | |
| 7,429,345 | B2 * | 9/2008 | Chiu | 264/259 |
| 2003/0209983 | A1 | 11/2003 | Harada | 313/586 |

FOREIGN PATENT DOCUMENTS

| | | |
|---|---|---|
| JP | 2845183 | 10/1998 |
| JP | 2917279 | 4/1999 |
| JP | 2000-215812 | 8/2000 |
| JP | 2001-043804 | 2/2001 |
| JP | 2001-325888 | 11/2001 |
| JP | 2002-302648 | 10/2002 |
| JP | 2003-132783 | 5/2003 |
| JP | 2003-297238 | 10/2003 |

OTHER PUBLICATIONS

Office Action from the Chinese Patent Office issued in Applicant's corresponding Chinese Patent Application No. 200410095973.4, dated Aug. 29, 2008.

Chinese Certificate of Patent for Invention Cert. No. 528372, corresponding to Korean Patent Application No. 10-2003-0076227. English abstract of Cert. No. 528372 is attached as No. CN 163003(A) which also corresponds to CN 100521035(C).

* cited by examiner

METHOD OF FORMING A DIELECTRIC FILM AND PLASMA DISPLAY PANEL USING THE DIELECTRIC FILM

CROSS-REFERENCE TO RELATED APPLICATIONS AND CLAIM OF PRIORITY

This application is a divisional of Applicant's Ser. No. 10/974,861 now U.S. Pat. No. 7,482,753 filed in the U.S. Patent & Trademark Office on 28 Oct. 2004, and assigned to the assignee of the present invention. Furthermore, this application makes reference to, incorporates the same herein, and claims all benefits accruing under 35 U.S.C. §119 from an application for PASTE FOR MAKING DIELECTRIC FILM AND PLASMA DISPLAY PANEL USING THE DIELECTRIC FILM earlier filed in the Korean Intellectual Property Office on 30 Oct. 2003 and there duly assigned Serial No. 2003-76227.

BACKGROUND OF THE INVENTION

1. Field of the Invention

The present invention relates to a method of forming a dielectric film and a plasma display panel (PDP) using the dielectric film, and more particularly, to a method of forming a dielectric film having excellent characteristics, and to a PDP using the dielectric film.

2. Description of the Related Art

PDPs display images using a gas discharge and have excellent characteristics, such as display capacity, brightness, contrast, afterimages, and an angular field. Accordingly, PDPs are in great demand as display devices to replace cathode-ray tubes. When a Direct Current (DC) or Alternating Current (AC) voltage is applied across electrodes in a PDP, a discharge occurs in a gas between the electrodes, creating ultraviolet rays which excite phosphor films, thereby creating an image.

PDPs can be categorized into DC PDPs and AC PDPs depending on a discharge mechanism. For DC PDPs, individual electrodes are directly exposed to gas that is hermetically sealed in discharge cells so that a voltage applied to the electrodes is directly applied to a discharge gas. For AC PDPs, individual electrodes are separated from a discharge gas by a dielectric film so that charged particles generated during discharge are not absorbed by the electrodes and form wall charges, and so that a gas discharge is induced using the wall charges.

In a PDP, a dielectric film is formed to cover electrodes arranged on a substrate. The dielectric film should have an excellent insulation characteristic and be freed from voids or pinholes after it is sintered.

To form a desired dielectric film, a paste should be formed of an insulating powder having a good droplet size distribution and other excellent characteristics, and an insulating paste mixed with a solvent and a binder should exhibit an appropriate viscosity and leveling characteristic.

Japanese Laid-Open Patent Publication No. 2002-302648 discloses a paste for making an insulating film, which uses a solvent having a contact angle of 5° or less with respect to a substrate in order to improve the wettability of the insulating paste.

Although the above-described paste for making the insulating film facilitates printing, dispersion of the paste is not considered.

Since the paste having a high dispersion can be coated on a substrate to a uniform thickness, the paste can form a dielectric film, which is effectively sintered and appropriate for a large-area PDP.

SUMMARY OF THE INVENTION

The present invention provides a method of forming a dielectric film having good characteristics and a Plasma Display Panel (PDP) using the dielectric film.

The present invention also provides a PDP that free of voids or pinholes and includes a uniform dielectric film.

According to one aspect of the present invention, a method of forming a dielectric film is provided, the method comprising: coating a paste on a substrate, and sintering the paste to form the dielectric film; wherein a lateral surface of a terminal portion of the dielectric film formed by the paste is formed to have a contact angle in a range of 30 to 80° with respect to a surface of the substrate.

The contact angle is preferably formed to have a range of 35 to 75°.

The terminal portion of the dielectric film formed by the paste is preferably formed to have a thickness in a range of 1 to 1.3 times higher than an average thickness of the dielectric film.

The method further preferably comprises forming the substrate of glass.

The method further preferably comprises forming the dielectric film by coating the paste on the substrate using a screen printing method.

According to another aspect of the present invention, a method of forming a dielectric film is provided, the method comprising: coating a paste on a substrate, and sintering the paste to form the dielectric film; wherein a terminal portion of the dielectric film is formed to have a thickness in a range of 1 to 1.3 times higher than an average thickness of the dielectric film.

The method further preferably comprises forming the substrate of glass.

The method further preferably comprises forming the dielectric film by coating the paste on the substrate using a screen printing method.

According to yet another aspect of the present invention, a plasma display panel is provides, the display panel comprising: a first substrate and a second substrate facing each other and forming a discharge space; a plurality of pairs of sustain electrodes arranged on the first substrate; and a plurality of address electrodes arranged on the second substrate; wherein at least one dielectric film is arranged between the first substrate and the second substrate; and wherein a lateral surface of a terminal portion of the dielectric film has a contact angle in a range of 30 to 80° with respect to a surface of the first substrate or the second substrate.

The lateral surface of the terminal portion of the dielectric film preferably has a contact angle in a range of 35 to 75° with respect to the surface of the first substrate or the second substrate.

The terminal portion of the dielectric film preferably has a thickness in a range of 1 to 1.3 times higher than an average thickness of the dielectric film.

The first substrate preferably comprises glass; the dielectric film is preferably arranged on a surface of the first substrate facing the second substrate; and the sustain electrodes are preferably arranged between the first substrate and the dielectric film.

The second substrate preferably comprises glass; the dielectric film is preferably arranged on a surface of the second substrate facing the first substrate; and the address electrodes are preferably arranged between the second substrate and the dielectric film.

The dielectric film preferably comprises a transparent material.

The dielectric film is preferably arranged on either the first substrate or the second substrate using a screen printing method.

According to still another aspect of the present invention, a plasma display panel is provided, the display panel comprising: a first substrate and a second substrate facing each other and forming a discharge space; a plurality of pairs of sustain electrodes arranged on the first substrate; and a plurality of address electrodes arranged on the second substrate; wherein at least one dielectric is arranged between the first substrate and the second substrate; and wherein a terminal portion of the dielectric film has a thickness in a range of 1 to 1.3 times higher than an average thickness of the dielectric film.

The first substrate preferably comprises glass; the dielectric film is preferably arranged on a surface of the first substrate facing the second substrate; and the sustain electrodes are preferably arranged between the first substrate and the dielectric film.

The second substrate preferably comprises glass; the dielectric film is preferably arranged on a surface of the second substrate facing the first substrate; and the address electrodes are preferably arranged between the second substrate and the dielectric film.

The dielectric film preferably comprises a transparent material.

The dielectric film is preferably arranged on the first substrate or the second substrate using a screen printing method.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in a which like reference symbols indicate the same or similar components, wherein.

DETAILED DESCRIPTION OF THE INVENTION

Hereinafter, an exemplary embodiment of the present invention will be described with reference to the attached drawings.

Figure 1:
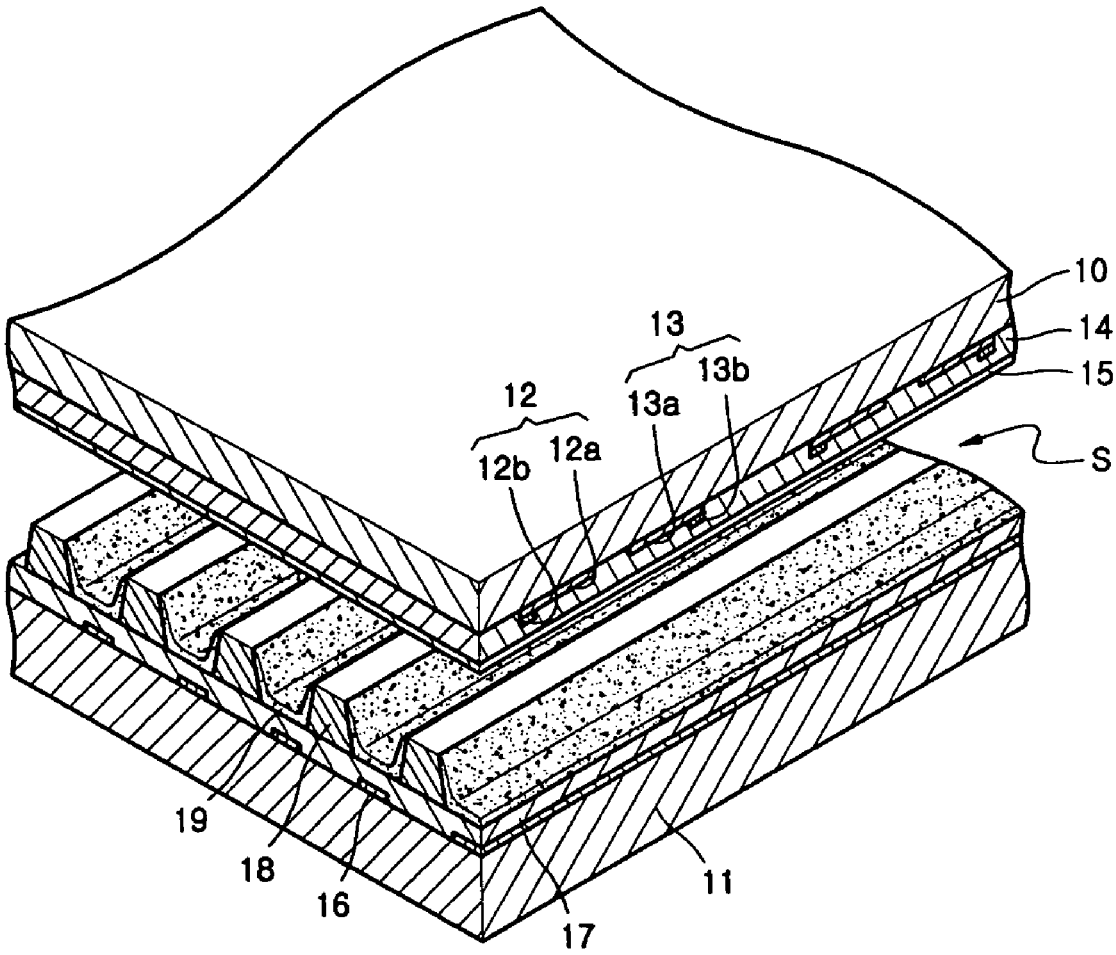
FIG. 1 is an exploded perspective view of a Plasma Display Panel (PDP) according to an embodiment of the present invention.

FIG. 1 is an exploded perspective view of a Plasma Display Panel (PDP) according to an embodiment of the present invention.

Referring to FIG. 1, a first substrate 10 and a second substrate 11, each of which is formed of a transparent glass, are arranged to face each other. A discharge gas, such as Ne or Xe, is injected into a discharge space S between the first and second substrates 10 and 11, and outer portions of the first and second substrates 10 and 11 are covered by a sealing member, such as a flit glass (not shown), and combined. The discharge space S is partitioned into a plurality of discharge cells by barrier ribs 18.

A plurality of pairs of first and second electrodes 12 and 13 are arranged on a bottom surface of the first substrate 10, which faces the second substrate 11, and are formed into a predetermined pattern, for example, into stripes. The first electrodes 12 and the second electrodes 13 can be X-electrodes and Y-electrodes, which correspond to common electrodes and scan electrodes, respectively. The first and second electrodes 12 and 13 are sustain electrodes to generate a sustain discharge.

The first electrodes 12 can include transparent electrodes 12*a*, which are formed of Indium Tin Oxide (ITO) that is a transparent conductive material, and bus electrodes 12*b*, which are formed of Ag or Au to prevent reductions in line resistances of the transparent electrodes 12*a*. Likewise, the second electrodes 13 can include transparent electrodes 13*a* formed of ITO and bus electrodes 12*b* formed of Ag or Au. It is apparent to those skilled in the art that the first electrodes 12 can be scan electrodes, and the second electrodes can be common electrodes.

The transparent electrodes 12*a* and 13*a* and the bus electrodes 12*b* and 13*b* of the first and second electrodes 12 and 13 can be formed using photolithography or a screen printing method. The bus electrodes 12*b* and 13*b* can be formed of Ag or Au containing a certain amount of black additives to improve a contrast characteristic.

A first dielectric film 14 is additionally formed on the bottom surface of the first substrate 10 on which the first and second electrodes 12 and 13 are formed, and this process will be described in detail later.

A MgO film 15 is additionally formed on a bottom surface of the first dielectric film 14, which faces the second substrate 11, to cover the first dielectric film 14. The MgO film 15 is formed by sputtering or deposition and functions as both a passivation film for the first dielectric film 14 and as a cathode during a gas discharge.

On a top surface of the second substrate 11, which faces the first substrate 10, address electrodes 16 are arranged orthogonal to the first and second electrodes 12 and 13, and the respective discharge cells are defined by intersections between the first and second electrodes 12 and 13, and the address electrodes 14. Each of the discharge cells forms a sub-pixel of the PDP.

The structures and patterns of the first electrodes 12, the second electrodes 13, and the address electrodes 16 can be variously changed according to design specifications.

The address electrodes 16 are insulated from the discharge space S by a second dielectric film 17 formed on the front surface of the second substrate 11 to cover the address electrodes 16. The second dielectric film 17 can be colored white to improve the brightness of the PDP.

The barrier ribs 18 are stripes formed on top of the second dielectric film 17 between the address electrodes 16 to partition the discharge space S into the discharge cells. A phosphor film 19 is formed on inner lateral surfaces of the barrier ribs 18 and top surfaces of the second dielectric films 17 surrounded by the barrier ribs 18. The phosphor film 19 has red (R), green (G), and blue (B) phosphors arranged in spaces partitioned by the barrier ribs 18 to realize a color screen. The barrier ribs 18 can be formed of an insulating dielectric material using various methods, such as a screen printing method, sand blasting, a dry film method, and photolithography.

The second dielectric film 17 can be omitted and only the phosphor film 19 formed on top of the address electrodes 16, so as to insulate the address electrodes 16 from the discharge space S.

The structure of barrier ribs 18 is not limited to the above description as long as the barrier ribs 18 can define the discharge cells. That is, the barrier ribs 18 can have the shape of lattices that surround respective discharge cells or octagons that partition not only discharge cells but also non-discharge regions adjacent to the discharge cells. The structure of the barrier ribs 18 can be variously changed.

The first and second dielectric films 14 and 17, which are respectively formed on the first and second substrates 10 and 11, can be formed of a paste for making a dielectric film according to an embodiment of the present invention.

The paste for making the dielectric film will be described with reference to FIGS. 4 and 5.

Figure 4:
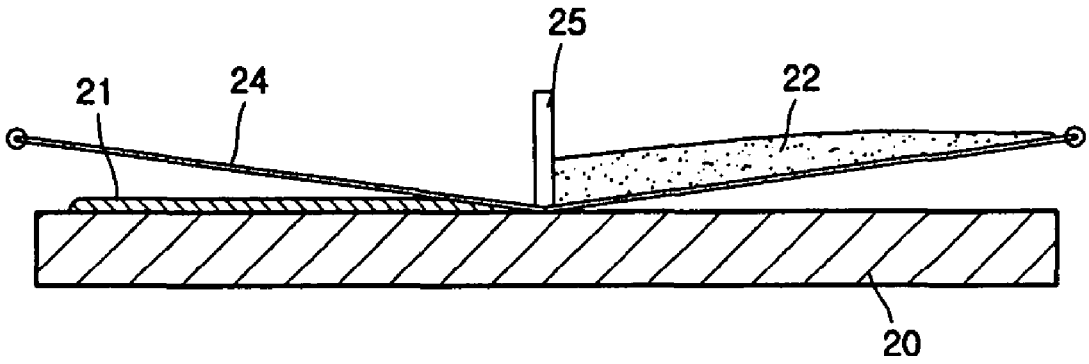
FIG. 4 is a partial cross-sectional view of a substrate illustrating a process of forming a dielectric film on a glass substrate using a screen printing method.
Figure 5:
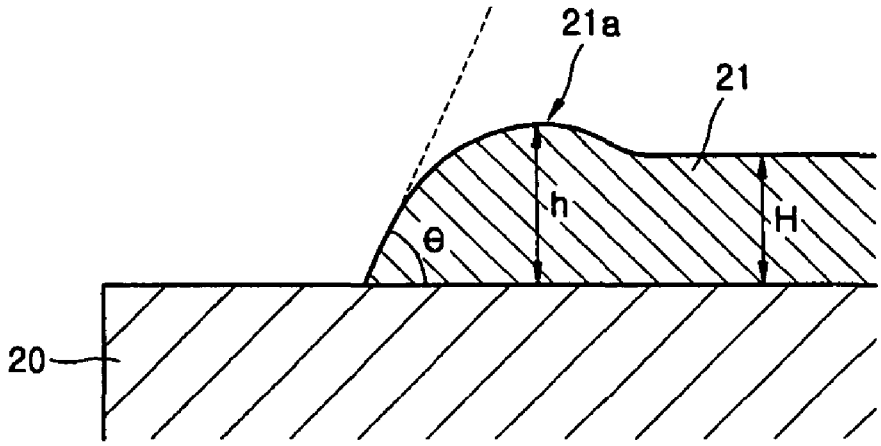
FIG. 5 is an exploded cross-sectional view of a terminal portion of the dielectric film formed by the process of FIG. 4.

FIG. 4 is a partial cross-sectional view of a substrate illustrating a process of forming a dielectric film 21 on a glass substrate 20 using a screen printing method, and FIG. 5 is an exploded cross-sectional view of a terminal portion of the dielectric film 21 formed by the process of FIG. 4.

Referring to FIG. 4, the dielectric film 21 can be formed of a paste 22 for a dielectric film according to an embodiment of the present invention. The paste 22 for the dielectric film is an insulating paste mixed with an inorganic glass fine-grain powder, a binder that binds the powder, and a predetermined organic solvent. The inorganic fine-grain powder can be formed of $SiO_2$, ZnO, $B_2O_3$, PbO, $Bi_2O_3$, BaO, $P_2O_5$, CaO, SrO, or MgO. The binder can be formed of cellulose-based materials, acryl-based materials, or polyvinyl alcohol-based materials. Also, the solvent can be any appropriate material in which the binder is soluble. In addition to the foregoing, other various kinds of inorganic fine-grain powders, binders, and solvents can be used instead.

By mixing the foregoing inorganic fine-grain powder, the binder, and the solvent in an appropriate mixture ratio, an inorganic paste having an optimal dispersion characteristic can be obtained as the paste 22 for the dielectric film.

In the present invention, the paste 22 having an optimal dispersion characteristic can be detected based on a contact angle measured at a terminal portion of the dielectric film 21 formed on the substrate 20 and a thickness of the terminal portion. The method of detecting whether or not the paste 22 for the dielectric film is an inorganic paste having an optimal dispersion characteristic will be described in detail with reference to FIG. 4.

Referring to FIG. 4, a screen mask 24 is arranged on a substrate 20 a predetermined distance apart from the substrate 20, and the paste 22 is coated on a top surface of the screen mask 24. Thereafter, the paste 22 is scrubbed using a bar 25 from one side of the substrate 20 to the other side so as to form the dielectric film 21 under the screen mask 24.

Then, the dielectric film 21 is sintered. FIG. 5 shows a terminal portion 21*a* of the resultant dielectric film 21.

Referring to FIG. 5, the terminal portion 21*a* of the dielectric film 21 rises high over other portions. The terminal portion 21*a* is referred to as an edge hill, which is necessarily formed the insulation characteristic of the paste 22.

According to the present invention, the characteristics of the paste 22 can be controlled by analogizing the dispersion of the paste 22 based on the shape of the terminal portion 21*a*.

At the outset, a contact angle θ of the terminal portion 21*a* of the dielectric film 21 with respect to a surface of the substrate 20 is checked. Thus, a paste for making a dielectric film, which allows the contact angle θ to range from 30 to 80°, is used. More preferably, the contact angle θ ranges from 35 to 75°.

That is, the paste 22 having a good dispersion can be detected using the contact angle θ of the terminal portion 21*a* of the dielectric film 21 with respect to the surface of the substrate 20.

In addition, the paste 22 having a good dispersion can be detected by measuring if a thickness h of the terminal portion 21*a* of the dielectric film 21 is 1 to 1.3 times an average thickness H of the dielectric film 21. If the thickness h of the terminal portion 21*a* of the dielectric film 21 is 1 to 1.3 times the average thickness H of the dielectric film 21, the paste 22 used for forming the dielectric film 21 is detected as having a good dispersion characteristic.

By using the foregoing paste 22 for the dielectric film 21, the first dielectric film 14 and/or the second dielectric film 17 as shown in FIG. 1 can be formed.

Figure 2:
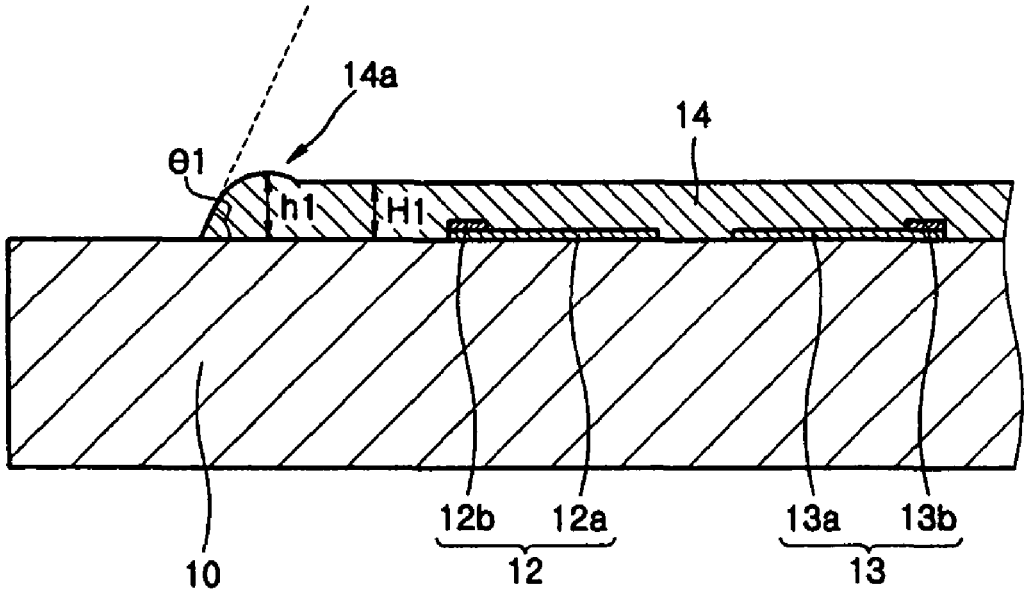
FIG. 2 is a partial cross-sectional view of a terminal portion of a first substrate of the PDP of FIG. 1.

As shown in FIG. 2, the first dielectric film 14 is formed on the top surface of the first substrate 10, which is formed of a transparent glass, where the first electrodes 12 and the second electrodes 13 are formed as stated above.

A paste for making a dielectric film is coated on top of the first substrate 10 where the first electrodes 12 and the second electrodes 13 are formed using a screen printing method, as shown in FIG. 4. The paste is then sintered to form a first dielectric film 14. The first dielectric film 14 is formed using the paste 22, which satisfies the forgoing conditions of contact angle and thickness. Specifically, a terminal portion 14*a* of the first dielectric film 14 formed using the paste should have a contact angle θ1 of about 30 to 80° (preferably, 35 to 75°) with respect to the first substrate 10. Also, a thickness h1 of the terminal portion 14*a* should be 1 to 1.3 times an average thickness H1 of the first dielectric film 14.

The paste 22, which forms the first dielectric film 14, can be an opaque material. As shown in FIG. 2, after the first dielectric film 14 is formed, a MgO film can be additionally formed on the first dielectric film 14 using sputtering or deposition.

Figure 3:
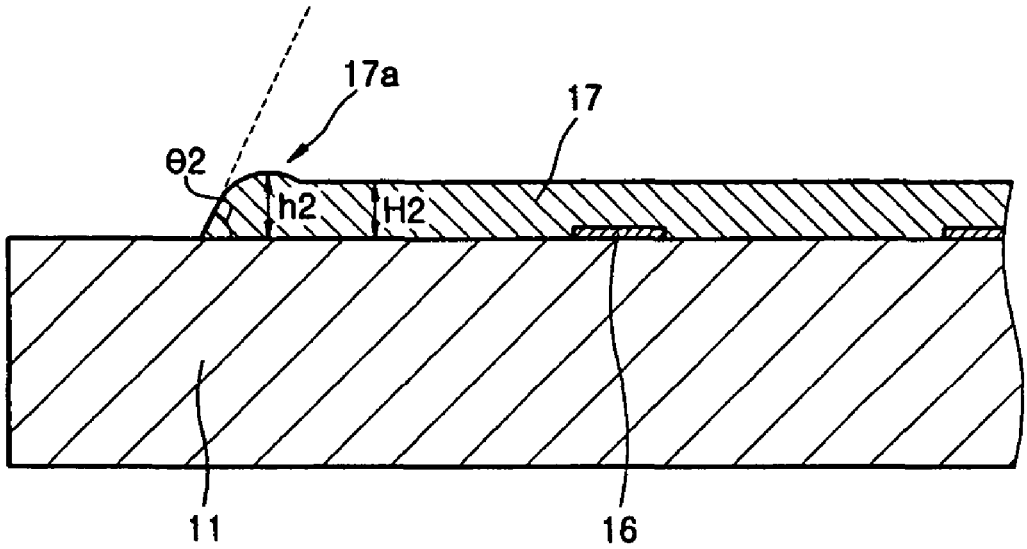
FIG. 3 is a partial cross-sectional view of a terminal portion of a second substrate of the PDP of FIG. 1.

The paste 22 can be also used to form the second dielectric film 17. As shown in FIG. 3, the paste 22 is coated on the second substrate 11 where the address electrodes 16 are formed as shown in FIG. 4, and sintered, thus forming the second dielectric film 17. A terminal portion 17*a* of the second dielectric film 17 should have a contact angle θ2 of 30 to 80° (preferably, 35 to 75°) with respect to the second substrate 11, and/or a thickness h2 of the terminal portion 17*a* should be 1 to 1.3 times an average thickness H2 of the second dielectric film 17.

The paste 22 for the second dielectric film 17 can be white in color. After the second dielectric film 17 is formed, barrier ribs and a phosphor film are additionally formed.

Since the paste 22 allows the terminal portions 14*a* and 17*a* to have the foregoing contact angle and thickness and has an excellent dispersion characteristic, the resultant dielectric films 14 and 17 can be uniformly formed and free of voids or pinholes.

The following Tables 1 and 2 show analysis results of various characteristics of the dielectric film 14 according to variations of the angle θ1 and the thickness h1 of the terminal portion 14*a*. In Tables 1 and 2, ○ refers to a case where the dielectric film 14 is in a good state, × refers to a case where it is impossible to apply the dielectric film 14 to products, and Δ refers to a case where the dielectric film 14 is not in a good state but it is possible to apply the dielectric film 14 to products.

TABLE 1

| | Contact Angle θ1 | Dispersion | Withstanding Voltage | Internal Bubbles | Surface Roughness | Uniformity |
|---|---|---|---|---|---|---|
| 1 | 25 | Δ | x | x | Δ | x |
| 2 | 30 | ○ | Δ | Δ | Δ | Δ |
| 3 | 35 | ○ | ○ | ○ | Δ | Δ |
| 4 | 40 | ○ | ○ | ○ | ○ | ○ |
| 5 | 45 | ○ | ○ | ○ | ○ | ○ |
| 6 | 50 | ○ | ○ | ○ | ○ | ○ |
| 7 | 55 | ○ | ○ | ○ | ○ | ○ |
| 8 | 60 | ○ | ○ | ○ | ○ | ○ |
| 9 | 65 | ○ | ○ | ○ | ○ | ○ |
| 10 | 70 | ○ | ○ | ○ | ○ | ○ |
| 11 | 75 | ○ | ○ | ○ | ○ | ○ |
| 12 | 80 | ○ | ○ | ○ | Δ | Δ |
| 13 | 85 | Δ | x | x | Δ | Δ |

TABLE 2

| | Average Thickness (H) | Thickness (h) of Terminal portion | h/H | Dispersion | Withstanding Voltage | Internal Bubbles | Uniformity |
|---|---|---|---|---|---|---|---|
| 1 | 20 mm | 22 mm | 1.1 | ○ | ○ | ○ | ○ |
| 2 | 20 mm | 23 mm | 1.15 | ○ | ○ | ○ | ○ |
| 3 | 20 mm | 24 mm | 1.2 | ○ | ○ | ○ | ○ |
| 4 | 20 mm | 25 mm | 1.25 | ○ | Δ | ○ | ○ |
| 5 | 20 mm | 26 mm | 1.3 | ○ | Δ | Δ | ○ |
| 6 | 20 mm | 27 mm | 1.35 | ○ | Δ | x | Δ |
| 7 | 20 mm | 28 mm | 1.4 | Δ | x | x | Δ |
| 8 | 20 mm | 29 mm | 1.45 | x | x | x | Δ |
| 9 | 20 mm | 30 mm | 1.5 | x | x | x | x |
| 10 | 20 mm | 31 mm | 1.55 | x | x | x | x |
| 11 | 20 mm | 32 mm | 1.6 | x | x | x | x |
| 12 | 20 mm | 33 mm | 1.65 | x | x | x | x |

As can be seen from Table 1, when the contact angle θ1 ranges from 35 to 75°, the first dielectric film 14 has excellent characteristics. Thus, a good dielectric film can be obtained by using a paste that allows the contact angle θ1 to range from 35 to 75°. Practically, the dielectric film can be formed using a paste that allows a contact angle θ1 to range from 30 to 80° in consideration of a process margin.

Also, as can be seen from Table 2, when the thickness h1 of the terminal portion 14*a* of the first dielectric film 14 is 1 to 1.3 times the average thickness H1 of the first dielectric film 14, the dielectric film 14 can have good characteristics.

The above-described paste for making the dielectric film can be used to form a dielectric film of a PDP, but the present invention is not limited thereto. That is, the paste according to the present invention can be applied to a dielectric film for any kind of displays or electronic devices.

As described above, the paste for making the dielectric film and the PDP using the dielectric film can have the following advantages.

Firstly, the paste has a good dispersion characteristic and can be detected using a simple method.

Secondly, the paste has excellent viscosity and a leveling characteristic and can be easily detected.

Thirdly, a dielectric film can be formed without voids, cracks, or pinholes due to internal bubbles.

Fourthly, a dielectric film having an improved withdrawing voltage characteristic can be applied to a PDP.

Fifthly, a uniform dielectric film appropriate for a large-area PDP can be obtained.

While the present invention has been particularly shown and described with reference to exemplary embodiments thereof, it will be understood by those of ordinary skill in the art that various modifications in form and detail can be made therein without departing from the spirit and scope of the present invention as recited in the following claims.

What is claimed is:

1. A method of forming a PDP, the method comprising:
forming a dielectric film on a substrate; and
forming a partition wall on the dielectric film;
wherein the forming of the dielectric film, comprising:
coating a paste on the substrate, and
sintering the paste to form the dielectric film,
wherein a terminal portion of the dielectric film formed by the paste is thicker than an average thickness of the dielectric film, and
wherein a lateral surface of the terminal portion of the dielectric film formed by the paste is formed to have a contact angle in a range of 30 to 80° with respect to a surface of the substrate.

2. The method of claim 1, wherein the contact angle is formed to have a range of 35 to 75°.

3. The method of claim 1, wherein the terminal portion of the dielectric film formed by the paste is formed to have a thickness in a range of 1.1 to 1.3 times higher than an average thickness of the dielectric film.

4. The method of claim 1, further comprising forming the substrate of glass.

5. The method of claim 1, further comprising forming the dielectric film by coating the paste on the substrate using a screen printing method.

6. A method of forming a PDP, the method comprising:
forming a dielectric film on a substrate; and
forming a partition wall on the dielectric film;
wherein the forming of the dielectric film, comprising:
coating a paste on the substrate, and
sintering the paste to form the dielectric film,
wherein a terminal portion of the dielectric film terminated at an edge of the substrate is formed to have a thickness in a range of 1.1 to 1.3 times higher than an average thickness of the dielectric film formed at other area of the substrate.

7. The method of claim 6, further comprising forming the substrate of glass.

8. The method of claim 6, further comprising forming the dielectric film by coating the paste on the substrate using a screen printing method.

* * * * *